US010378393B2

(12) United States Patent
Hayman et al.

(10) Patent No.: US 10,378,393 B2
(45) Date of Patent: Aug. 13, 2019

(54) CAM FOLLOWER ASSEMBLY AND METHOD OF MANUFACTURING THEREOF

(71) Applicant: GM GLOBAL TECHNOLOGY OPERATIONS LLC, Detroit, MI (US)

(72) Inventors: Alan W Hayman, Romeo, MI (US); Jared M Satkowiak, Grand Blanc, MI (US); Robert S McAlpine, Lake Orion, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 37 days.

(21) Appl. No.: 15/610,891

(22) Filed: Jun. 1, 2017

(65) Prior Publication Data

US 2018/0347412 A1 Dec. 6, 2018

(51) Int. Cl.

| | |
|---|---|
| ***F01L 1/14*** | (2006.01) |
| ***F01L 1/18*** | (2006.01) |
| ***F01L 13/00*** | (2006.01) |
| ***F01L 1/047*** | (2006.01) |
| ***F01L 1/46*** | (2006.01) |

(52) U.S. Cl.

CPC ..... *F01L 1/14* (2013.01); *F01L 1/047* (2013.01); *F01L 1/18* (2013.01); *F01L 1/462* (2013.01); *F01L 13/0005* (2013.01)

(58) Field of Classification Search

CPC . F01L 1/14; F01L 1/181; F01L 1/2405; F01L 1/18; F01L 1/462; F01L 13/0005

USPC ..... 123/90.39, 90.44, 90.48, 90.5, 90.61, 123/90.65, 90.67

See application file for complete search history.

(56) References Cited

U.S. PATENT DOCUMENTS

| | | | | |
|---|---|---|---|---|
| 6,397,806 | B2 * | 6/2002 | Imai | F01L 1/143 123/48 |
| 7,673,601 | B2 | 3/2010 | Spath et al. | |
| 2001/0047782 | A1 | 12/2001 | Imai et al. | |
| 2007/0295293 | A1 | 12/2007 | Spath et al. | |

* cited by examiner

*Primary Examiner* — Ching Chang

(74) *Attorney, Agent, or Firm* — Cantor Colburn LLP

(57) ABSTRACT

An improved cam follower for a vehicle engine includes a body, a spring seat, a tower, a spring and an anti-rotation member. The body defines a body diameter, a first open end, and a second end. The spring seat includes a spring seat opening and an interlock portion. The spring seat may be affixed to the first open end of the body. The spring seat further includes a spring seat diameter wherein the spring seat diameter is greater than the body diameter. The tower may be disposed in a pin housing through the spring seat opening at the first open end of the body. The tower further includes an upper flange and a spring which abuts the upper flange at a first spring end. The second spring end abuts the spring seat. The anti-rotation member accordingly may be coupled to the body via the spring seat.

15 Claims, 7 Drawing Sheets

CAM FOLLOWER ASSEMBLY AND METHOD OF MANUFACTURING THEREOF

TECHNICAL FIELD

The present disclosure relates to cam followers and more particularly directed to a cam follower assembly for selectively deactivating a cylinder in an internal combustion engine.

BACKGROUND

Selective deactivation of cylinders in multiple cylinder internal combustion engines is known in the art. For example, it is known in eight cylinder engines to selectively deactivate two or more cylinders during light bad conditions. Such deactivation of cylinders can therefore increase fuel efficiency. Various devices are known in the art to deactivate combustion chamber valves for improving fuel efficiency during specific engine load conditions.

Older systems have proposed to deactivate cylinders by simply cutting off the supply of fuel to selective cylinders. However such systems suffer from the drawback that each deactivated cylinder continuously imports, compresses, and expels unignited air significantly reducing the efficiency of the engine. It was then suggested to selectively deactivate cylinders by deactivating the valve assembly to eliminate the continuous pumping by the deactivated cylinders. One such system proposed to cut off an entire bank of a six-cylinder engine and utilized an additional complicated mechanical device to hold open the exhaust valves to eliminate losses previously endured during the compression stroke. Other complicated mechanical valve drive solutions have also been suggested which heretofore have not provided a viable solution to cylinder deactivation.

It is also known to provide a roller hydraulic lifter valve between a cam and a rocker arm in a conventional cam in head driven valve assembly in an internal combustion engine. A hydraulic cam follower is mounted to the head of the engine and disposed between the cam and the rocker arm. A source of pressurized oil is provided to the hydraulic lifter to provide zero lash adjustment and is conventional in the art. When the valve closes, oil flows into the tappet body to urge a lifter pushrod to contact the valve train and take up any clearance. As the camshaft pushes on the lifter a check valve may be closed to seal the oil inside the lifter such that the lifter then acts as a solid unit.

Accordingly, it is an object of the present disclosure to provide a simple means to selectively deactivate valve operation of specific cylinders during certain engine load conditions while reducing risk of surface damage to the cam lobes. It is further desirable to provide a deactivation means which requires few changes to existing components and may be employed within the existing space occupied by conventional valve-train components.

SUMMARY

The present disclosure provides an improved cam follower for a vehicle engine which enables increased lost motion range, which when combined with a rocker arm with reduced "cam lift to valve lift" ratio, reduces the risk of cam spalling. The improved cam follower includes a body, a spring seat, a tower, a spring and an anti-rotation member. The body defines a body diameter, a first open end, and a second end. The spring seat includes a spring seat opening and an interlock portion. The spring seat may be affixed to the first open end of the body. The spring seat further includes a spring seat diameter wherein the spring seat diameter is greater than the body diameter. The tower may be disposed in a pin housing through the spring seat opening at the first open end of the body. The tower further includes an upper flange and a spring which abuts the upper flange at a first spring end. The second spring end abuts the spring seat. The anti-rotation member accordingly may be coupled to the body via the spring seat. In one embodiment, the anti-rotation member may be movably affixed to the spring seat via a tongue in groove engagement with the spring seat wherein the spring seat and body may slide relative to the anti-rotation member. It is understood that the spring may include a spring diameter which is approximately equal to the body diameter.

The anti-rotation member is coupled to the body via the spring seat. In one example, non-limiting embodiment, the anti-rotation member may define a rail-tab feature in an interior wall which engages with an outer groove defined in a peripheral region of the spring seat. The anti-rotation member includes a first open end and a second open end, the first open end having a diameter greater than the spring seat diameter and greater than the second open end.

In one example, non-limiting embodiment, the first region 15 of the body may include a rail defined in an outer surface of the body. The rail may be configured to slidably engage with the interlock member of the spring seat upon assembling the spring seat to the first open end of the body. It is further understood that a rolling member may be affixed to the body at the second end such that the rolling member may engage with a cam on a camshaft.

It is further understood that the pin housing may be disposed entirely within the body. A locking member may be further disposed within the pin housing where the locking member may also be configured to extend from the pin housing and engage with an inner wall of the body upon actuation.

The present disclosure also provides a method for assembling an improved cam follower. The method includes the steps of: (1) providing an anti-rotation member having a spring seat disposed within an upper region of the anti-rotation member; (2) providing a main body having a first open end; (3) providing an anti-rotation member having a spring seat disposed within an upper region of the anti-rotation member; (4) inserting the main body into the anti-rotation member via the second end of the anti-rotation member; and (5) lowering the spring seat from the upper region of the anti-rotation member and affixing the spring seat to the main body proximate to the first open end of the main body, the spring seat being configured to couple the main body to the anti-rotation member; and (6) attaching the tower having a primary spring to a pin housing disposed within the main body.

The spring seat in the aforementioned assembly method defines a spring seat diameter and the body defines a body diameter such that the spring seat diameter is greater than the body diameter. Moreover, the primary spring defines a spring diameter which may be approximately equal to the body diameter. The anti-rotation member of the aforementioned method may define upper and lower tabs to retain the spring seat prior to the assembly process.

The present disclosure and its particular features and advantages will become more apparent from the following detailed description considered with reference to the accompanying drawings.

BRIEF DESCRIPTION OF THE DRAWINGS

These and other features and advantages of the present disclosure will be apparent from the following detailed description, best mode, claims, and accompanying drawings in which:

Like reference numerals refer to like parts throughout the description of several views of the drawings.

DETAILED DESCRIPTION

Figure 1:
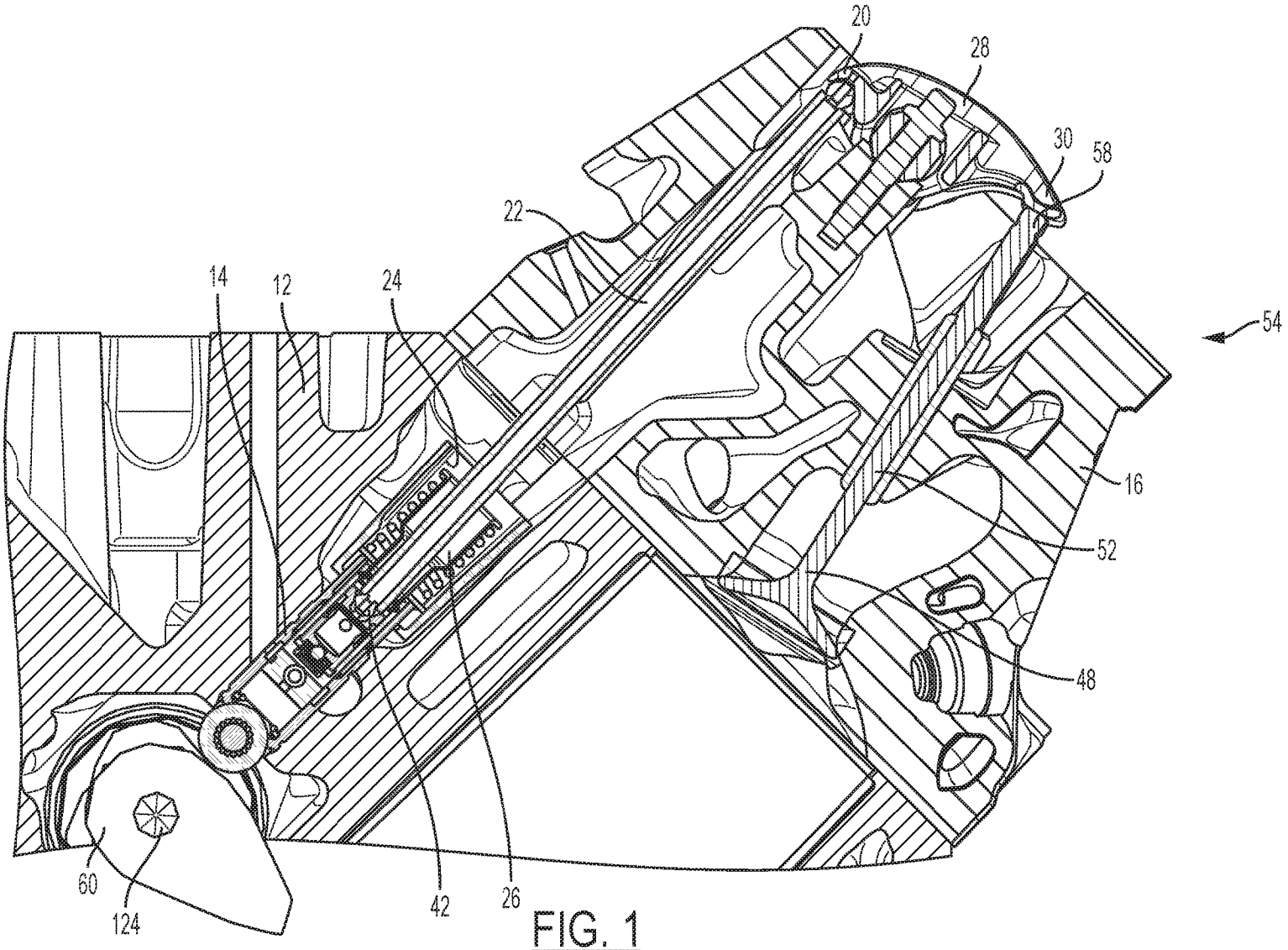
FIG. 1 is a cross sectional view of the cam follower assembly according to the present disclosure wherein the cam follower assembly is disposed within an engine block and operable to enable the valve to open and close.

Reference will now be made in detail to presently preferred compositions, embodiments and methods of the present disclosure, which constitute the best modes of practicing the present disclosure presently known to the inventors. The figures are not necessarily to scale. However, it is to be understood that the disclosed embodiments are merely exemplary of the present disclosure that may be embodied in various and alternative forms. Therefore, specific details disclosed herein are not to be interpreted as limiting, but merely as a representative basis for any aspect of the present disclosure and/or as a representative basis for teaching one skilled in the art to variously employ the present disclosure.

Except in the examples, or where otherwise expressly indicated, all numerical quantities in this description indicating amounts of material or conditions of reaction and/or use are to be understood as modified by the word "about" in describing the broadest scope of the present disclosure. Practice within the numerical limits stated is generally preferred. Also, unless expressly stated to the contrary: percent, "parts of," and ratio values are by weight; the description of a group or class of materials as suitable or preferred for a given purpose in connection with the present disclosure implies that mixtures of any two or more of the members of the group or class are equally suitable or preferred; the first definition of an acronym or other abbreviation applies to all subsequent uses herein of the same abbreviation and applies mutatis mutandis to normal grammatical variations of the initially defined abbreviation; and, unless expressly stated to the contrary, measurement of a property is determined by the same technique as previously or later referenced for the same property.

It is also to be understood that this present disclosure is not limited to the specific embodiments and methods described below, as specific components and/or conditions may, of course, vary. Furthermore, the terminology used herein is used only for the purpose of describing particular embodiments of the present disclosure and is not intended to be limiting in any way.

It must also be noted that, as used in the specification and the appended claims, the singular form "a," "an," and "the" comprise plural referents unless the context clearly indicates otherwise. For example, reference to a component in the singular is intended to comprise a plurality of components.

The term "comprising" is synonymous with "including," "having," "containing," or "characterized by." These terms are inclusive and open-ended and do not exclude additional, un-recited elements or method steps.

The phrase "consisting of" excludes any element, step, or ingredient not specified in the claim. When this phrase appears in a clause of the body 14 of a claim, rather than immediately following the preamble, it limits only the element set forth in that clause; other elements are not excluded from the claim as a whole.

The phrase "consisting essentially of" limits the scope of a claim to the specified materials or steps, plus those that do not materially affect the basic and novel characteristic(s) of the claimed subject matter.

The terms "comprising", "consisting of", and "consisting essentially of" can be alternatively used. Where one of these three terms is used, the presently disclosed and claimed subject matter can include the use of either of the other two terms.

Throughout this application, where publications are referenced, the disclosures of these publications in their entireties are hereby incorporated by reference into this application to more fully describe the state of the art to which this present disclosure pertains.

The following detailed description is merely exemplary in nature and is not intended to limit the present disclosure or the application and uses of the present disclosure. Furthermore, there is no intention to be bound by any theory presented in the preceding background or the following detailed description.

The present disclosure provides an improved cam follower 10 for a vehicle engine 54 which enables increased lost motion range of the roller thereby reducing the risk of cam spalling. With reference to FIG. 1, a cross sectional view of the cam follower assembly 10 of the present invention is shown. The cam follower assembly 10 is disposed within an engine block 12 and operable to enable the valve 48 to open and close against a combustion chamber 50 via the rocker arm 28 and push-rods 22.

Referring again to FIG. 1, the cam follower assembly 10 is part of a cam 60 in head 56 arrangement in an internal combustion engine 54. A cam 60 of a camshaft is rotatably mounted within the head 56 of the engine 54 as is commonly known in the art. A valve 48 having a valve 48 stem 52 extends from cylinder head 56 toward the rocker arm 28 as is also commonly known in the art. A coiled spring (not shown) biases the valve 48 stem 52 upward in the closed position. The rocker arm 28 is pivotally mounted within the head 56 of the engine as is also commonly known in the art. A first end 30 of the rocker arm 28 engages a top portion of the valve 48 stem 52. A lash adjuster is also provided to adjust valve 48 clearance. In the embodiment shown in FIG. 1, cam follower assembly 10 is mounted within a bore of the head 56 of the engine 54 between the cam 60 and a second end 20 of the rocker arm 28. As the cam 60 rotates the cam follower assembly 10 is forced upwards to engage the second end 20 of the rocker arm 28 causing the rocker arm 28 to pivot and displace the first end 30 of the rocker arm 28 downward to open the valve 48. The hydraulic cam follower assembly 10 may be disposed between the cam 60 and rocker arm 28 to provide zero lash adjustment. The basic arrangement for the position of the valve 48, combustion chamber 50 and cam shaft 124 is generally known in the art. The present invention is directed to the improved structure of the cam follower assembly 10 to support reduced cam spalling while meeting packaging requirements in such a layout.

Pitting is generally known as a surface fatigue phenomenon which occurs in the concentrated rolling and sliding contact area on the cam lobe 60 in the region where the roller 64 makes contact. Due to the high stresses between the two members as the contact area for the cam lobe 60 surface geometry changes against the roller 64, particles may break out of affected areas, leaving cam lobe 60 surfaces pockmarked with scattered holes. As the pitting progresses to a macro level, a cam lobe spalling condition may occur where the pits on the cam lobe 60 surface coalesce and form irregular craters, cavities and cracks. Cam lobe spalling may occur at 60 degrees from the top of the nose whereas sliding wear may be concentrated at the top of the nose of the cam lobe 60. The large particles that pits produce may be caught in the oil filter or settle at the bottom of the sump. Moreover, when cam lobe spalling occurs, this condition may present operational issues for the combustion chamber 50. Therefore, in order to significantly reduce the cam lobe spalling issue, a cam lobe follower assembly 10 is provided in the present disclosure which allows for an increased range of motion thereby, when combined with a rocker arm with reduced "cam lift to valve lift" ratio, relieving the excessively high concentration of stresses between the roller 64 and the cam lobe 60.

Figure 3A:
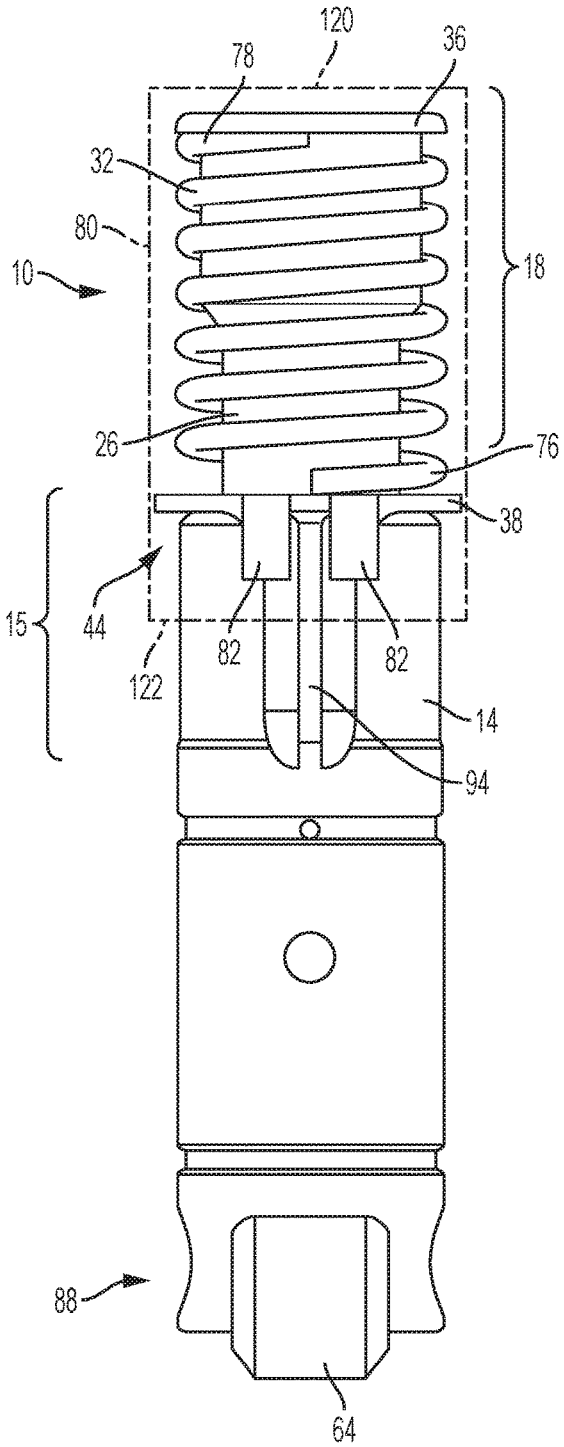
FIG. 3A is a front view of a cam follower having increased lost motion range in accordance with the present disclosure with the anti-rotation member shown in phantom.
Figure 3B:
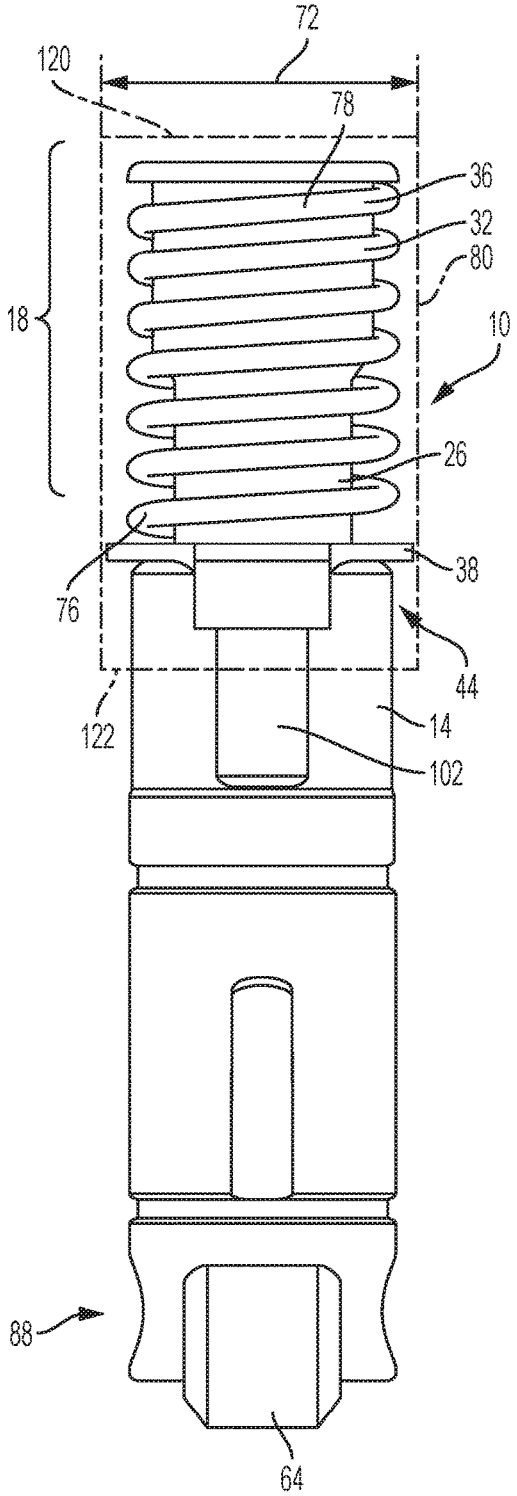
FIG. 3B is a rear view of a cam follower having increased lost motion range in accordance with the present disclosure with the anti-rotation member shown in phantom.

With reference again to FIG. 1, the cam follower assembly 10 of the present invention includes a main body 14 and a tower 26 positioned within a first end of the main body bore 92. Preferably the main body 14 and the tower 26 associated with the main body 14 are seated in a portion of the head 56 of the engine 54 conventionally suited for hydraulic cam followers. The upper or first end 18 of the cam follower assembly 10 is adapted to engage the second end 20 of the rocker arm 28 via a pushrod 22. As shown, the pushrod 22 is disposed within a bore 24 of the tower 26 such that the tower 26 and main body 14 engage the second end 20 of the rocker arm 28. A primary spring 32 is disposed in spring recess 34 defined by an upper flange 36 of the tower 26, the tower side wall 40, and the spring seat 38. It is further understood that an anti-rotation member 80 may surround this the primary spring 32 and the first end 18 of the cam follower assembly 10. The primary spring 32 is operatively configured to bias the pushrod 22 and its associated combustion chamber 50 valve 48 into an extended position. A clip 42 may, but not necessarily, be provided proximate to the first end 44 of the main body 14 to limit the movement of the pushrod 22 and prevent the pushrod 22 from escaping the bore 92 of the main body 14. A locking member 46 may be further provided to lock the pushrod 22 in the extended position for normal activated operation of the cam follower assembly 10. During normal operation, where the valve 48 and locking member 46 is activated as shown in FIG. 3A, the cam 60 causes the cam follower assembly 10 together with the pushrod 22 to move up and down in a reciprocating manner to engage the rocker arm 28 and reciprocatingly operate the valve 48. FIG. 1 shows the cam follower assembly 10 and valve 48 in a closed position. However, when the valve 48 and locking member 46 are not activated as shown in FIG. 3B, the locking member 46 is stowed in a retracted position enabling roller 64 and the main body 14 to slide up the cam follower axis toward the tower 26, pin housing 62 and the body 14 as the cam lobe 60 geometry changes. That is the force exerted by the cam lobe 60 against the roller 64 overcomes the biasing force provided by the primary spring 32 when the locking member 46 is deactivated as shown in FIG. 3 such that the roller 64 and main body 14 slide upward relative to the pin housing 62 and tower 26. Accordingly, the position of the pushrod 22 is not affected, and therefore, the combustion chamber valve 48 is not actuated despite the cam lobe 60 engaging the roller 64.

With further reference to the roller 64 in FIGS. 3A-3D, a roller 64 may be rotatably mounted to a second end 88 of the main body 14 of the cam follower assembly 10 and engages a portion of the cam lobe 60 to provide a rolling interface there between. However, as indicated, as the cam 60 rotates the cam follower assembly 10 and pushrod 22 are forced upward and the rocker arm 28 pivots and the valve 48 opens when the locking member 46 is actuated given that the cam follower does not "absorb" the movement/force applied by the cam lobe 60. Therefore, when the locking member 46 is actuated, the entire cam follower assembly 10 together with the pushrod 22 is urged in the upward most position as the roller 64 engages the highest portion of the cam. Consequently, the rocker arm 28 pivots clockwise and the valve stem 52 is forced downward to open the valve 48. As the cam lobe 60 continues to rotate, the valve 48 is then allowed to close by virtue of the biasing force of the spring (not shown) in the cylinder head.

Figure 3C:
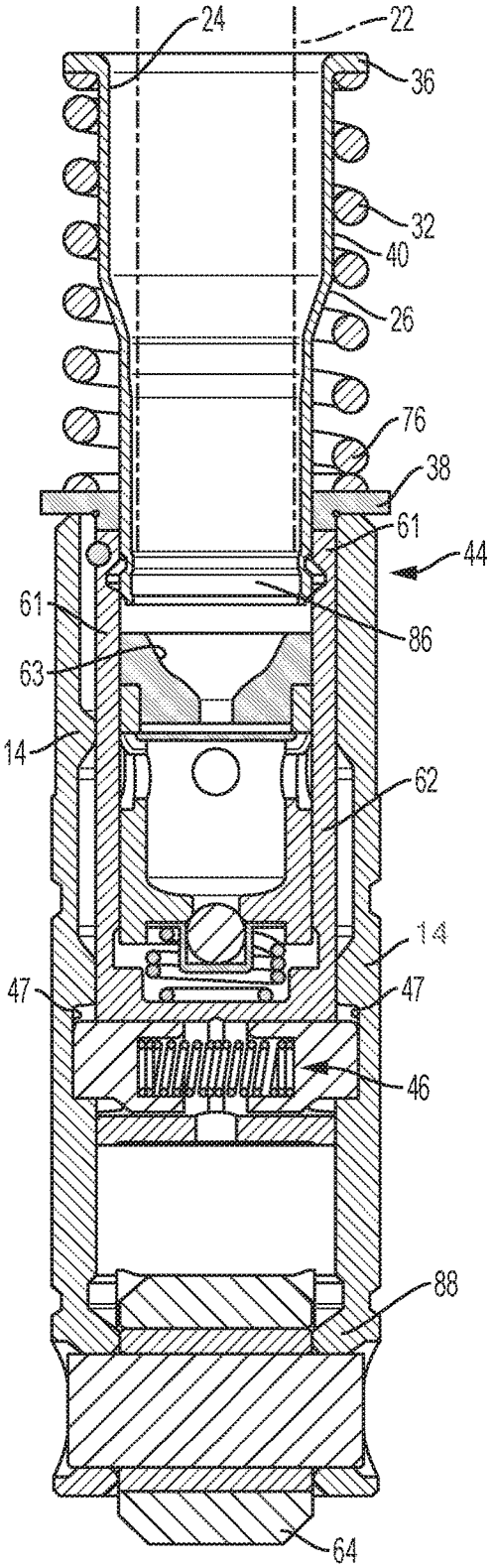
FIG. 3C is a cross-sectional view of a cam follower in accordance with the present disclosure with the cam follower in an activated mode.
Figure 3D:
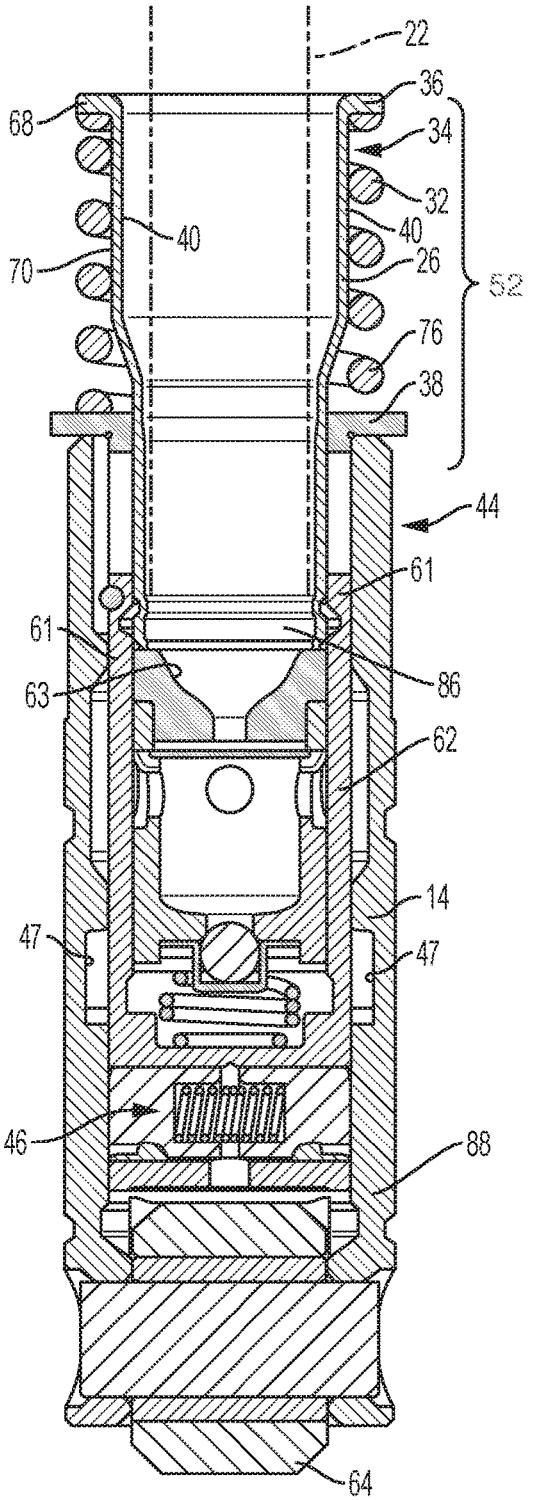
FIG. 3D is a cross-sectional view of a cam follower in accordance with the present disclosure with the cam follower in a deactivated mode.

However, when the valve 48 is to be deactivated, the locking member 46 disengages with the inner surface of the main body 14, as shown in FIG. 3D, to allow the pushrod 22 to recede within the bore 24 of the tower 26 and main body 14 to take up the cam 60 lift so that the valve 48 is not opened. As can be seen in FIG. 3D, the roller 64 may engage the cam 60 (not shown) at its highest point which causes upward movement of the roller 64 in comparison to FIG. 3C. However, the rocker arm 28 and valve 48 of FIG. 1 shall remain in the closed position when the cam follower 10 is deactivated. It is understood that, in this example, pressurized oil may selectively supplied to the locking member 46 to disengage the locking member 46 from the main body 14 thereby releasing the pushrod 22/pin housing 62/tower 26 subsystem 52 relative to the main body 14 and thus permitting the pushrod 22 to move deeper within the bore of the main body 14. As the cam 60 urges the main body 14 upward, the pushrod 22 remains substantially stationary relative to the cylinder head 56. Accordingly, when the locking member 46 is disengaged (or deactivated), the main body 14 and roller 64 rides upward relative to the tower 26 and pin housing 62 such that the pushrod 22 recess 34*es* further within the bore 24 when the highest point of the cam lobe 60 engages with the roller 64. The spring biases the pushrod 22 upward relative to the main body 14 to engage the second end 20 of the rocker arm 28. Similarly, a primary spring 32 urges the main body 14 and roller 64 downward to maintain constant contact with the cam 60.

Due to issues with respect to cam spalling at the roller 64 interface, the cam follower assembly 10 must slightly be adjusted to allow for increased motion range in order to prevent excessive force at the roller 64-cam 60 interface. However, the camshaft follower must also comply with packaging constraints with respect to the engine block 12 and the rocker arm 28. For example, it is understood that the length of the primary spring 32 may not be increased to allow for increased range, due to packaging limitations with respect to the push rod 22 and the rocker arm 28. Therefore, in order to adjust the spring force (spring constant) to enable increased motion range in the camshaft follower, the spring (made from steel) for the valve adjuster may alternatively be widened to approximately the same diameter as the body 14 such that the resulting spring force is changed.

Figure 2A:
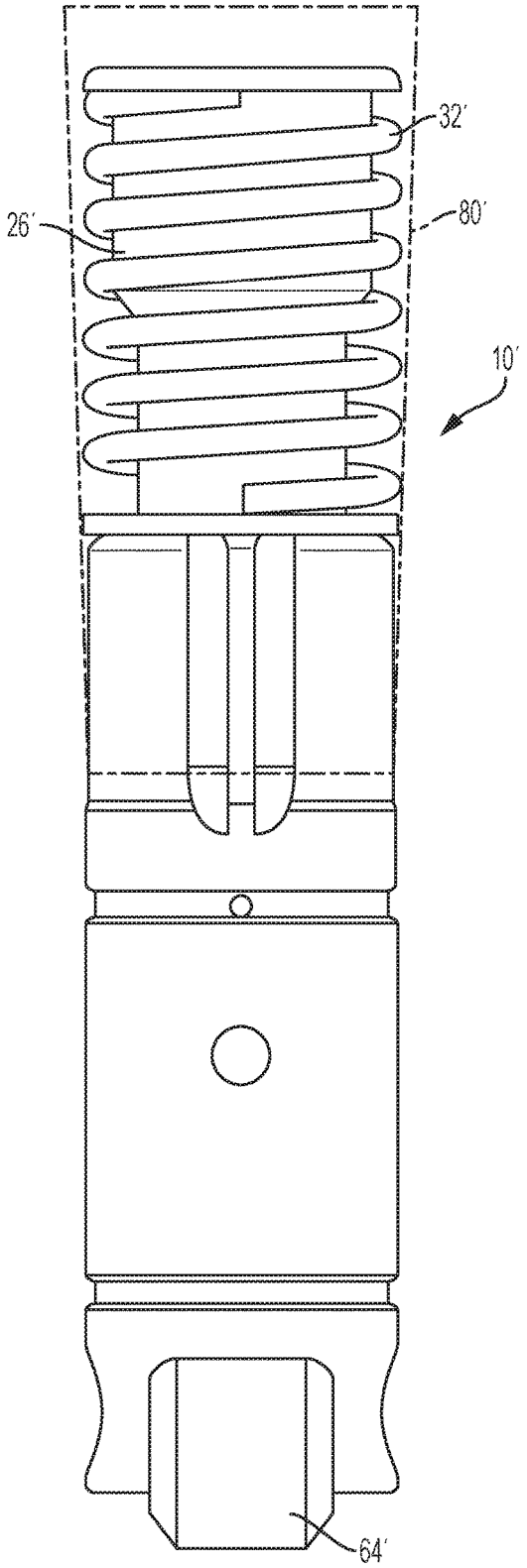
FIG. 2A PRIOR ART
FIG. 2A is a front view of a prior art cam follower according to the present disclosure.
Figure 2B:
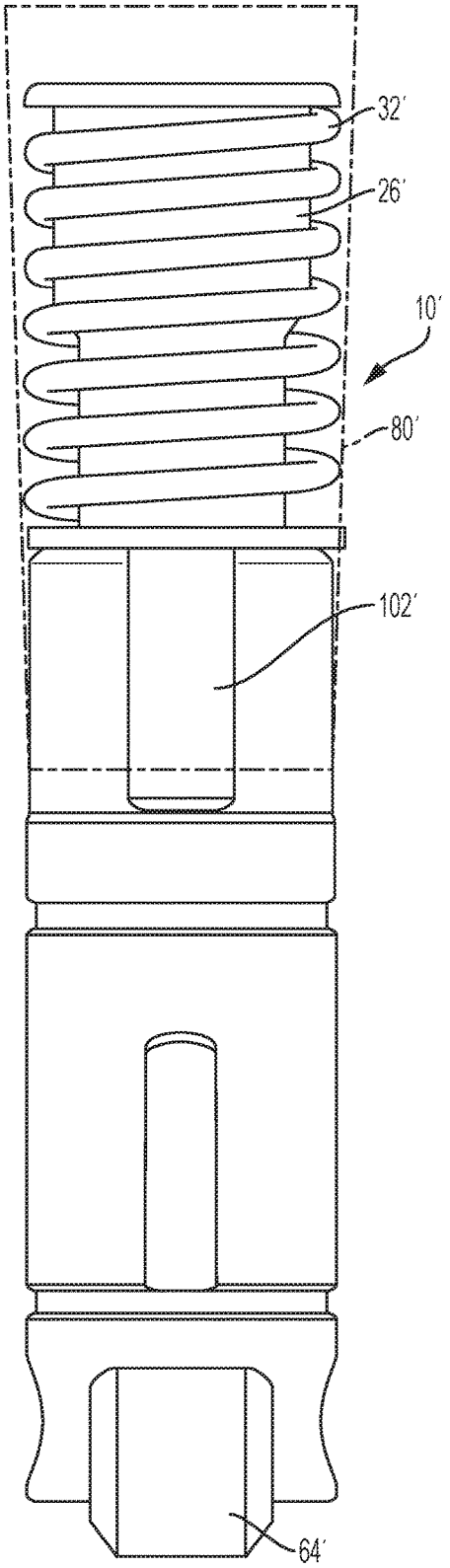
FIG. 2B PRIOR ART
FIG. 2B is a rear view of a prior art cam follower according to the present disclosure.

FIG. 2A is a front view of a prior art cam follower. FIG. 2B is a rear view of a prior art cam follower 10' where the anti-rotation member 80' is shown in phantom. It is understood that the anti-rotation member 80' engages only with the rail 94' defined on the front side the main body 14' and the platform 102' defined on the rear side of the main body 14' when assembled as part of a traditional cam follower assembly 10'. It is further understood that the traditional cam follower assembly 10' of FIGS. 2A-2B implement primary spring 32' made from steel which has a spring diameter 70 which is equal to approximately 90% of the length of the main body diameter 68. Accordingly, the traditional cam follower 10' of FIGS. 2A-2B may implement a primary spring 32' which may have a specified spring constant. In contrast to the traditional cam follower 10' of FIGS. 2A and 2B, the present disclosure implements a cam follower 10 with a primary spring 32 with a revised spring constant due to its wider geometry. The primary spring 32 and the cam follower assembly 10 of the present disclosure therefore allows for increased motion range of the main body 14 and roller 64 thereby reducing the risk of cam spalling.

In order to accommodate the wider spring 32 for the improved cam follower assembly 10 of the present disclosure; a spring seat 38 as shown in FIGS. 3A and 3B is provided wherein the spring seat diameter 74 is greater than both the spring diameter 70 and the diameter of the body 14. The spring seat 38 further couples the anti-rotation member 80 to the main body 14.

It is also understood that in the present disclosure, the spring seat 38, which has a spring seat diameter 74 greater than the diameter of the body 14, is also operatively configured to couple the body 14 to the anti-rotation member 80. That is the spring seat 38 of the present disclosure may be operatively configured to enable the main body 14 and pin housing 62 to slide relative to the anti-rotation member 80 as the roller 64 and/or pushrod 22 move. Moreover, the spring seat 38 of the present disclosure together with the modified spring design is operatively configured to enable the cam follower 10 to provide additional motion range towards and away from the cam lobe 60 as the cam lobe 60 rotates toward the cam follower assembly 10. Accordingly, the risk of cam spalling is significantly reduced.

With reference to FIGS. 3A-3D, the improved cam follower 10 includes a body 14, a spring seat 38, a tower 26, a primary spring 32 and an anti-rotation member 80. FIG. 3A is a front view of a cam follower 10 of the present disclosure where the anti-rotation member 80 shown in phantom while FIG. 3B is a rear view of the cam follower in FIG. 3A. As shown, the main body 14 (or body 14) defines a body diameter 68, a first end 44, and a second end 88. The spring seat 38 includes a spring seat aperture 84 and an interlock portion 82. The spring seat 38 may be affixed to the first end 44 of the body 14. The spring seat 38 further includes a spring seat diameter 74 wherein the spring seat diameter 74 is greater than the body diameter 68. The tower 26 may be disposed in a pin housing 62 through the spring seat aperture 84 at the first end 44 of the body 14. The tower 26 further includes an upper flange 36 and a spring which abuts the upper flange 36 at a first spring end 78. The second spring end 76 abuts the spring seat 38. The anti-rotation member 80 accordingly may be coupled to the body 14 via the spring seat 38. In one embodiment, the anti-rotation member 80 may be movably affixed to the spring seat 38 via a mechanical interlock with the spring seat 38 wherein the spring seat 38 and body 14 may slide relative to the anti-rotation member 80. It is understood that the primary spring 32 may include a spring diameter 70 which is approximately equal to the body diameter 68.

The anti-rotation member 80 is coupled to the body 14 via the spring seat 38. In one example, non-limiting embodiment, the anti-rotation member 80 may define a rail-tab 96 in an interior wall 100 which engages with an outer groove 104 defined in a peripheral region 106 of the spring seat 38. The anti-rotation member 80 includes a first open end 120 and a second open end 122, the first open end 120 having a diameter 72 greater than the spring seat diameter 74.

In one example, non-limiting embodiment, the first region of the body 14 may include a rail 94 defined in an outer surface of the body 14. The rail 94 may be configured to slidably engage with the interlock portion 82 of the spring seat 38 upon assembling the spring seat 38 to the first end 44 of the body 14. Similar to the roller 64 previously described, it is further understood that a rolling member 64 may be affixed to the body 14 at the second end 88 such that the rolling member 64 may engage with a cam 60 on a camshaft 124.

With reference to FIGS. 3C-3D, the pin housing 62 supports the push rod seat 63 within the main body 14, and is fixed relative to the tower 26. However, as shown in FIGS. 3C-3D, the main body 14 moves relative to the pin housing 62 and tower 26. As shown, the pin housing 62 may be affixed to a second end 86 of the tower 26. The pin housing 62 may also be disposed entirely within the body 14 such that the pin housing 62 may slide relative to the main body 14 depending on whether the locking member 46 is engaged (as shown in FIG. 3C) or disengaged (as shown in FIG. 3D). When the locking member 46 is engaged into the locking recesses 47 defined in the interior wall of the main body 14, the first end 61 of the pin housing 62 may be disposed proximate to or adjacent to the first end 44 of the main body 14 as shown in FIG. 3C. However, when the locking member 46 is disengaged from the main body 14, the main body 14 and roller 64 of the cam follower 10 may slide (via the spring seat 38) relative to the pushrod 22 and pin housing 62 which remain stationary. Accordingly, the improved cam follower assembly 10 with primary spring 32 prevents cam spalling by reducing the stresses imposed on the cam 60 by the roller 64 when the locking member 46 is disengaged and the wider primary spring 32 is implemented.

Figure 7:
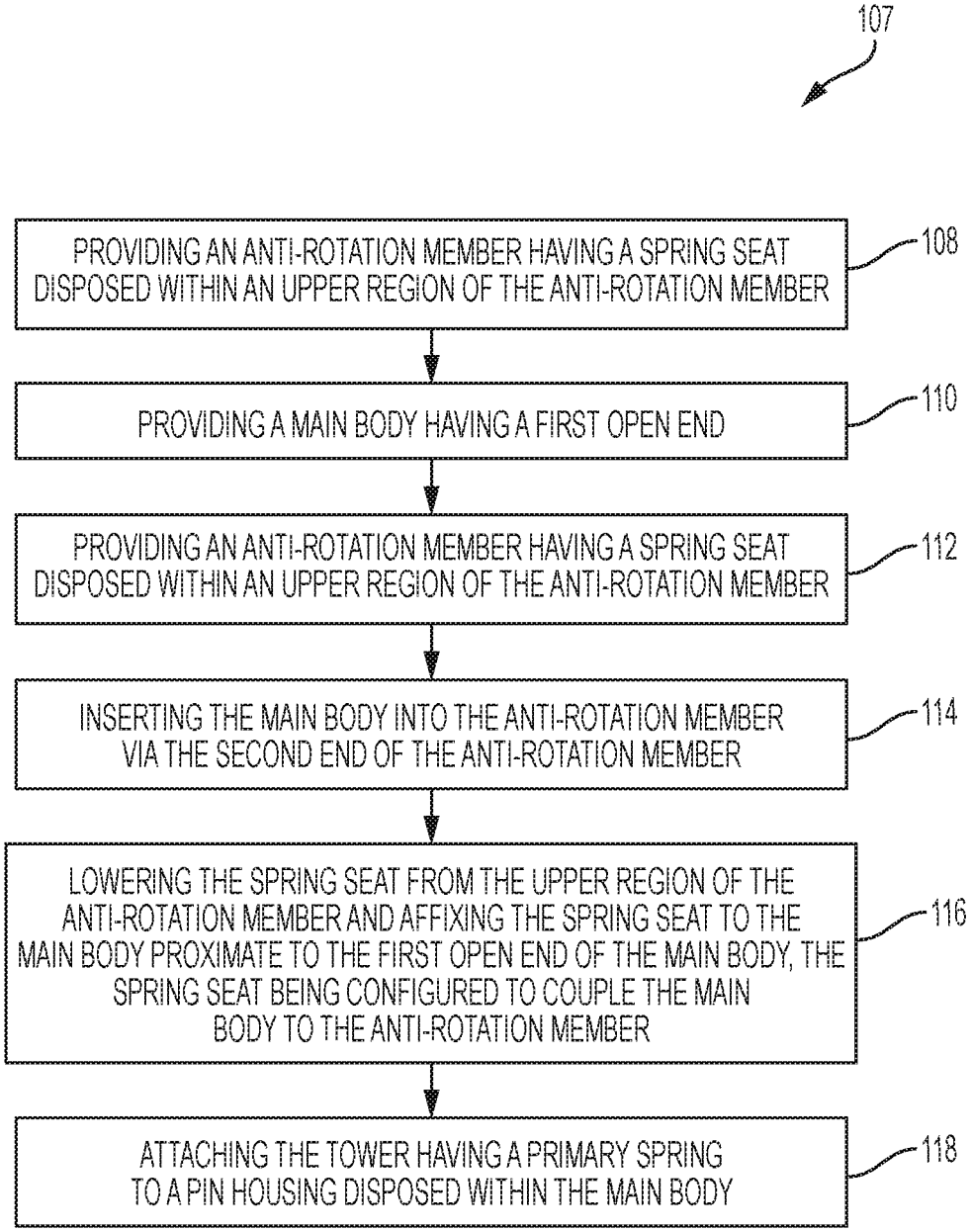
FIG. 7 is a flow chart which illustrates the manufacturing method of the present disclosure.

Referring now to FIG. 7, a flow chart is shown which illustrates the manufacturing method 107 of the present disclosure. The method for assembling an improved cam follower according to the present disclosure includes the steps of: (1) providing an anti-rotation member having a spring seat disposed within an upper region of the anti-rotation member; 108 (2) providing a main body having a first open end; 110 (3) providing an anti-rotation member having a spring seat disposed within an upper region of the anti-rotation member; 112 (4) inserting the main body into the anti-rotation member via the second end of the anti-rotation member; 114 and (5) lowering the spring seat from the upper region of the anti-rotation member and affixing the spring seat to the main body proximate to the first open end of the main body, the spring seat being configured to couple the main body to the anti-rotation member; 116 and (6) attaching the tower having a primary spring to a pin housing disposed within the main body. 118

Figure 4:
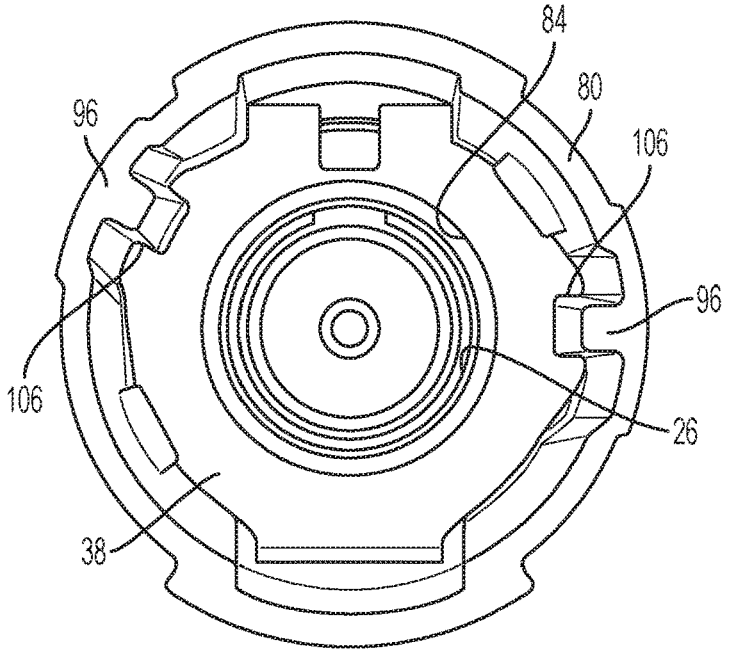
FIG. 4 is a plan view of the anti-rotation member with the spring seat disposed within the anti-rotation member prior to assembly.
Figure 6:
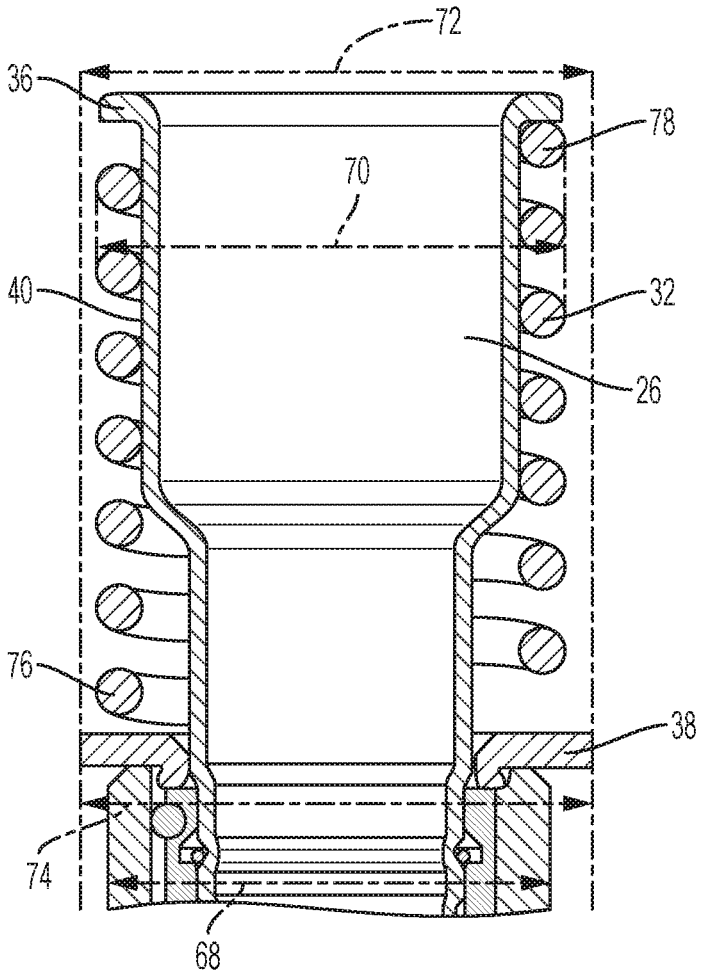
FIG. 6 is partial cross-sectional view of the tower and spring installed onto the body of the cam follower of the present disclosure.

It is understood that the primary spring 32 includes a first spring end 78 and a second spring end 76. The first spring end 78 abuts an upper flange 36 of the tower 26 at a first spring end 78 and abuts the spring seat 38 at a second spring end 76 upon assembly. The spring recess 34 is therefore defined by the tower side wall 40, the upper flange 36, and the spring seat 38, and the spring recess 34 is configured to retain the primary spring 32 as described above for the improved cam follower assembly 10. Therefore, the second spring end 76 (shown in FIG. 3A) is supported by the spring seat 38 as shown in FIG. 6. It is understood that FIG. 4 is a plan view of the anti-rotation member 80 with the spring seat 38 disposed within the anti-rotation member 80 prior to assembling the tower 26 and primary spring 32 to the cam follower assembly 10. As shown in FIG. 4, a plan view of the spring seat 38 is shown inside of the anti-rotation member 80 where the spring seat 38 is affixed to the main body 14. The spring seat 38 provides a surface to support the primary spring 32, and as shown in FIG. 4, the spring seat 38 may further define grooves at a peripheral region 106 of the spring seat 38 which engage with interior wall rails 96 of the anti-rotation member 80 to enable the spring seat 38, and the main body 14 to move up and down the anti-rotation member 80 as needed when the locking member 46 activates and deactivates.

Figure 5:
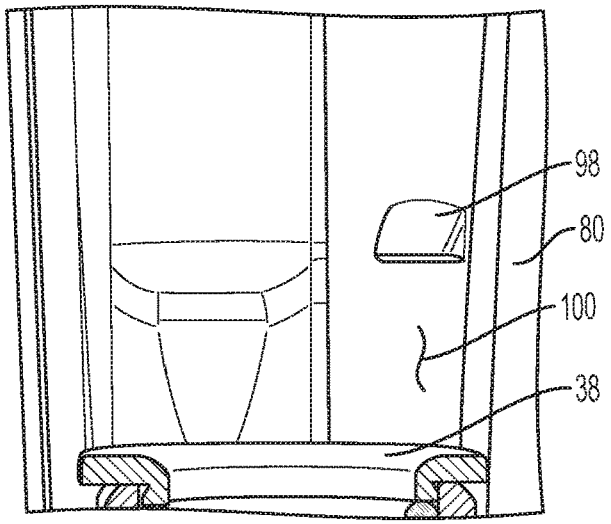
FIG. 5 is a partial cross-sectional view of the anti-rotation member with the interior wall exposed.

With reference to FIG. 5, a partial cross-sectional view of the anti-rotation member 80 is shown with the interior wall of the anti-rotation member 80 exposed. The anti-rotation member 80 may optionally further define at least one tab 98 on the interior wall 100 to retain the spring seat 38 inside of the anti-rotation member 80 prior to the assembly of the cam follower 10.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the disclosure in any way. Rather, the foregoing detailed description will provide those skilled in the art with a convenient road map for implementing the exemplary embodiment or exemplary embodiments. It should be understood that various changes can be made in the function and arrangement of elements without departing from the scope of the disclosure as set forth in the appended claims and the legal equivalents thereof.

What is claimed is:

1. An improved cam follower for a vehicle engine comprising:

a body operatively configured to engage with a cam via a rolling member, the body defining a body diameter, a first open end, and a second end;

a spring seat defining a spring seat opening and an interlock portion integral to the spring seat, the spring seat being affixed to the first open end of the body via the interlock portion engaging with a first region of the body, the spring seat defining a spring seat diameter wherein the spring seat diameter is greater than the body diameter;

a tower operatively configured to couple a pushrod to the body, the tower being disposed in a pin housing through the spring seat opening at the first open end of the body, the tower having an upper flange;

a spring disposed between the spring seat and the upper flange of the tower; and an anti-rotation member movably affixed to the spring seat.

2. The improved cam follower as defined in claim 1 wherein the first region of the body includes a rail defined in an outer surface of the body, the rail configured to slidably engage with an interlock member of the spring seat.

3. The improved cam follower as defined in claim 2 wherein the spring includes a spring diameter which is equal to the body diameter.

4. The improved cam follower as defined in claim 3 wherein the rolling member is affixed to the body at the second end.

5. The improved cam follower as defined in claim 4 wherein a locking member is disposed within the pin housing and the locking member being configured to extend from the pin housing and engage with an inner wall of the body upon actuation.

6. The improved cam follower as defined in claim 5 wherein the anti-rotation member defines a tongue feature which engages with an outer groove defined in a peripheral region of the spring seat.

7. The improved cam follower as defined in claim 6 wherein the anti-rotation member includes a first open end and a second open end, the first open end having a diameter greater than the spring seat diameter.

8. The improved cam follower as defined in claim 7 wherein the anti-rotation member is coupled to the body via the spring seat.

9. A method for assembling an improved cam follower, the method comprising the steps of:

providing an anti-rotation member having a spring seat disposed within an upper region of the anti-rotation member;

providing a main body having a first open end;

inserting the main body into the anti-rotation member via a second end of the anti-rotation member;

lowering the spring seat from the upper region of the anti-rotation member and affixing the spring seat to the main body proximate to the first open end of the main body, the spring seat being configured to couple the main body to the anti-rotation member; and attaching a tower having a primary spring to a pin housing disposed within the main body.

10. The method for assembling an improved cam follower as defined in claim 9 wherein the spring seat defines a spring seat diameter and the main body defines a body diameter, the spring seat diameter being greater than the body diameter.

11. The method for assembling an improved cam follower as defined in claim 10 wherein the primary spring defines a spring diameter which is equal to the body diameter.

12. The method for assembling an improved cam follower as defined in claim 11 wherein the anti-rotation member defines an upper tab to retain the spring seat prior to assembling the anti-rotation member.

13. The method for assembling an improved cam follower as defined in claim 12 wherein a locking member is disposed within the main body with the pin housing.

14. The method for assembling an improved cam follower as defined in claim 13 wherein the locking member is configured to extend from the pin housing and engage with an inner wall of the main body upon actuation of the locking member.

15. The improved cam follower as defined in claim 14 wherein the anti-rotation member defines a wall rail defined in an interior wall of the anti-rotation member, the wall rail being configured to engage with an outer groove defined in a peripheral region of the spring seat.

* * * * *